US008472816B2

(12) United States Patent
Muto

(10) Patent No.: US 8,472,816 B2
(45) Date of Patent: Jun. 25, 2013

(54) PROCESS CARTRIDGE AND IMAGE FORMING APPARATUS

(75) Inventor: Kazufumi Muto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 305 days.

(21) Appl. No.: 12/624,674

(22) Filed: Nov. 24, 2009

(65) Prior Publication Data

US 2010/0129101 A1 May 27, 2010

(30) Foreign Application Priority Data

Nov. 27, 2008 (JP) ..... 2008-302431

(51) Int. Cl.
*G03G 15/00* (2006.01)

(52) U.S. Cl.
USPC ..... 399/13

(58) Field of Classification Search
USPC ..... 399/13, 110, 113, 115, 116, 167
See application file for complete search history.

(56) References Cited

U.S. PATENT DOCUMENTS

| | | | | |
|---|---|---|---|---|
| 6,157,792 | A | 12/2000 | Mori et al. | 399/24 |
| 6,404,996 | B1 | 6/2002 | Mori et al. | 399/24 |
| 7,480,474 | B2 | 1/2009 | Muto | 399/175 |
| 2006/0245784 | A1* | 11/2006 | Tsuzuki et al. | 399/111 |
| 2006/0257167 | A1* | 11/2006 | Kim et al. | 399/167 |
| 2009/0028601 | A1 | 1/2009 | Mizuno et al. | 399/111 |
| 2009/0116869 | A1 | 5/2009 | Kotsuka et al. | 399/111 |
| 2009/0290905 | A1 | 11/2009 | Mizuno et al. | 399/111 |

FOREIGN PATENT DOCUMENTS

| | | |
|---|---|---|
| JP | 2000-181328 | 6/2000 |

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

A process cartridge is detachably mountable to a main assembly of an image forming apparatus and includes an image bearing member, a developing device having a developer carrier, a transmitter transmitting a driving force received from the main assembly to the developer carrier, a charger movable toward and away from the image bearing member, for charging the image bearing member while contacting the image bearing member, a spacer, detachably mountable relative to the cartridge, for holding the charger at a position away from the image bearing member when the spacer is mounted and for permitting the charger to charge the image bearing member when the spacer is dismounted, and a drive controller for disengaging the driving connection between the transmitter and the developer carrier when the spacer is mounted, and for establishing the driving connection between the transmitter and the developer carrying member when the spacer is dismounted.

9 Claims, 14 Drawing Sheets

PROCESS CARTRIDGE AND IMAGE FORMING APPARATUS

FIELD OF THE INVENTION AND RELATED ART

The present invention relates to a process cartridge usable for an electrophotographic image forming apparatus and this.

Here, the electrophotographic image forming apparatus forms the image on a recording material using an electrophotographic type process. Examples of the electrophotographic image forming apparatus include an electrophotographic copying machine, an electrophotographic printer (laser beam printer, LED printer, for example), a facsimile device, and a word processor.

The process cartridge integrates into a cartridge as a unit an electrophotographic photosensitive drum and at least one process means which acts thereon, and is detachably mountable to an electrophotographic image forming apparatus main assembly.

In an image forming apparatus of an electrophotographic type, an electrostatic image corresponding to the image information is formed by exposure means on an electrophotographic photosensitive member uniformly charged by a charging member. This electrostatic image is visualized by a developer and the visualized image is transferred onto the recording material to form an image. In order to make device maintenance easy, in the process cartridge type, a photosensitive member and charging means, developing means, cleaning means, and so on as the process means are unified integrally into a unit is detachably mountable to an image forming apparatus main assembly. The charging means carries out an electrical charging operation by being supplied with a voltage from a main assembly. The developing means of the process cartridge is provided with a developer carrying member (developing sleeve) for carrying the developer and this developing sleeve is rotated by receiving a driving force from a main assembly side, when the process cartridge is mounted to the main assembly. The voltage is supplied from the main assembly and the developing operation is carried out.

According to such a process cartridge, a user itself can carry out the supplying of the developer and the exchange of the parts which reached the lifetime thereof easily by mounting the process cartridge to the image forming apparatus main assembly. Therefore, the type is extremely excellent in the maintenance property.

Here, ordinarily, the charging means is of a non-contact charging type which uses a corona discharge and so on or a contact charging type which uses a charging roller and so on. Recently, a latter is used widely, since the required voltage is low. In a roller charging device of a contact charging type, an electroconductive rubber roller is supported rotatably and contacted to the surface of the electrophotographic photosensitive drum. By applying the predetermined voltage to the charging roller, the photosensitive drum is charged to a predetermined potential.

In a charging device of the contact charging type, it is desirable that the charging device is assuredly contacted to the surface of the photosensitive drum. For this reason, the charging roller is press-contacted to the surface of the drum with a predetermined urging force. For this reason, when saved in the press-contacted state for a long period of time, the charging roller is deformed only in one place. In this case, there is a possibility that a permanent deformation which results from a creep phenomenon of the rubber may occur, and therefore, the material of the charging roller has to be selected carefully.

Japanese Laid-open Patent Application 2000-181328 discloses another method for preventing the creep deformation of the charging roller in which a spacer member is interposed between a core metal of the charging roller and the photosensitive drum to space the charging roller from the photosensitive drum, thus preventing the deformation of a rubber surface layer of the charging roller.

However, in Japanese Laid-open Patent Application 2000-181328, the spacer member is provided with a knob with which it projected from the process cartridge so that an operator can demount the spacer member. In the state where the spacer member is mounted the spacer member interferes with an apparatus opening, and therefore, the process cartridge cannot be mounted to the image forming apparatus, and therefore the operator does not mount the process cartridge to the image forming apparatus, without dismounting the spacer member.

On the other hand, from the viewpoint of a reduction of a work amount of the operator and a reduction of an installing time, it is desirable to ship the image forming apparatus in the state that the process cartridge is mounted to the inside of the image forming apparatus main assembly (co-packing). In this case, the process cartridge which has the spacer member is mounted to the inside of the main assembly, and therefore, the interference of the spacer member described above is unavailable.

However, when the image forming operation is started, in the state that the spacer member is mounted, the developing means is operated with the photosensitive drum not charged, with the result that a large amount of developer is supplied to the photosensitive drum If this occurs, the process cartridge and the image forming apparatus may be contaminated, and a formed image may be contaminated.

SUMMARY OF THE INVENTION

Then, it would be considered that a presence or absence of a spacer member is detected, and, in the case where there is a spacer member an image forming operation of a main assembly is prohibited.

However, when a malfunction of such a sensing device occurs, the sensing of the presence or absence of the spacer member is not carried out correctly. In such a case, by the operation of the developing device, the problem described above arises.

Accordingly and it is a principal object of the present invention to provide a process cartridge and an image forming apparatus, wherein in the case of not removing the spacer member from a process cartridge, the problem by the operation of the developing device is avoided assuredly.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

A process cartridge according to the embodiment of the present invention will be described.

The preferred embodiments of the present invention will be described in conjunction with the accompanying drawings

First Embodiment

Figure 1:
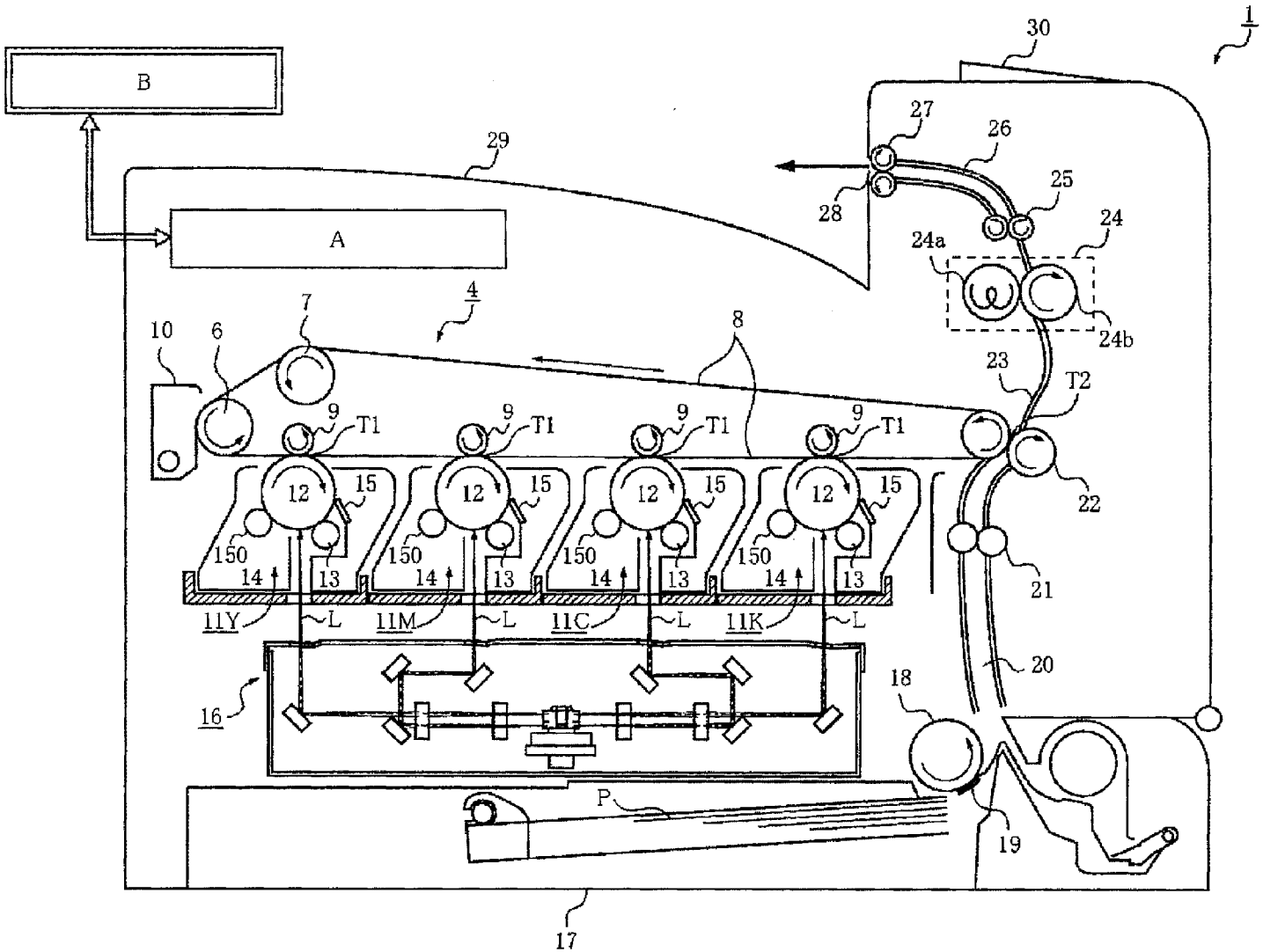
FIG. 1 is a schematic illustration of a front sectional view of an image forming apparatus in the embodiment 1.
Figure 2:
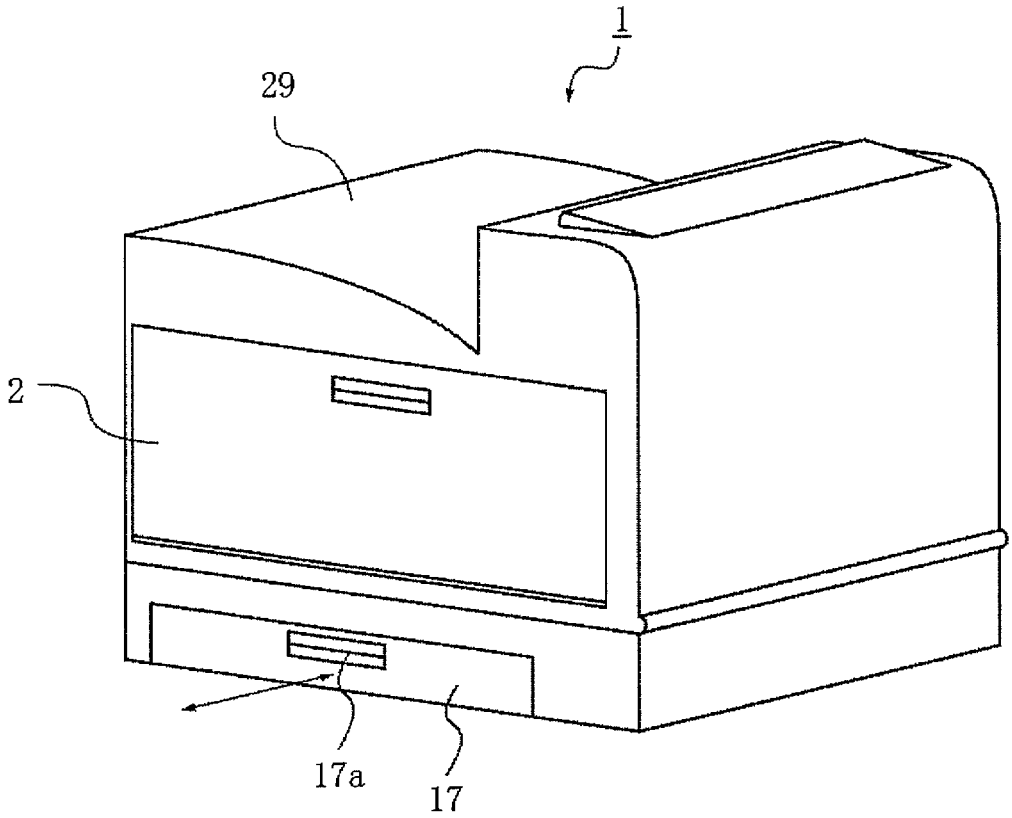
FIG. 2 is a perspective view of an outer appearance of the image forming apparatus.
Figure 3:
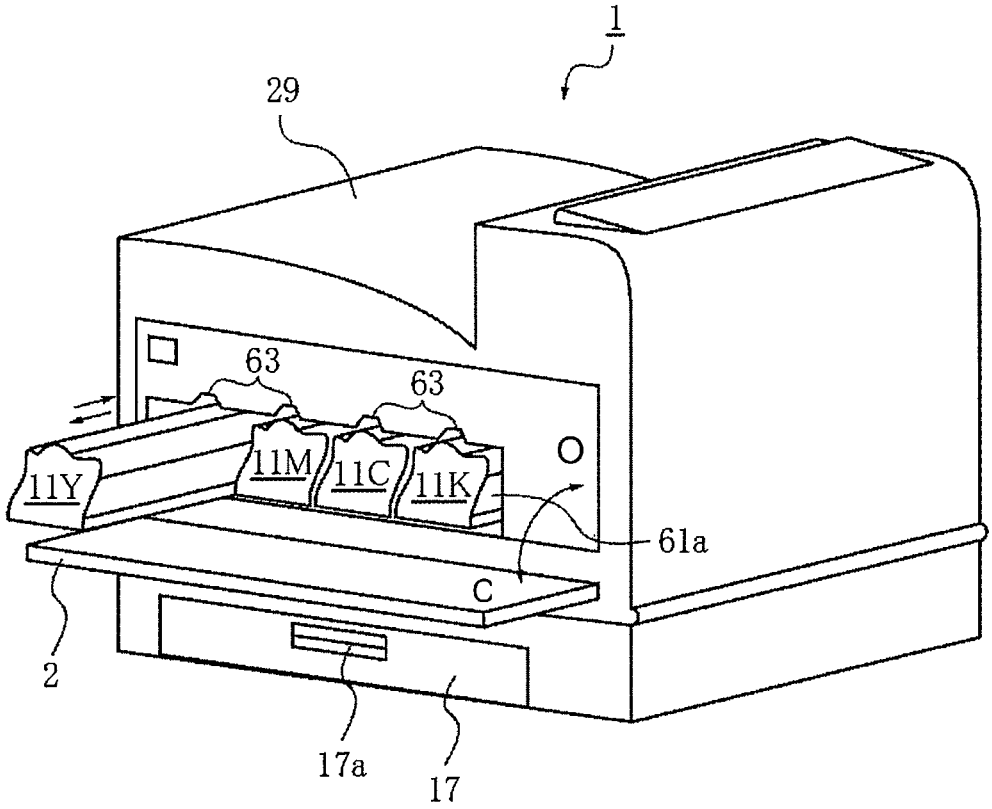
FIG. 3 is a perspective view of an outer appearance of the image forming apparatus in the state that an openable and closable door is opened and the cartridge is mounted and demounted.

FIG. 1 is a schematic longitudinal front section of the image forming apparatus in the present embodiment. FIG. 2 is a perspective view of an outer appearance of the image forming apparatus. FIG. 3 is a perspective view of an outer appearance of the image forming apparatus showing a state in which an openable and closable door is opened, and one of the four process cartridges (image formation units) is in the process of insertion or extraction relative to a mounting portion.

An image forming apparatus 1 of the present embodiment uses an intermediary transfer belt 8, and it is an electrophotographic full-color printer of a four-drum tandem type. This image forming apparatus 1 forms and outputs the image corresponding to the electric image information supplied from an external host device B communicatably connected with a control circuit portion (CPU) A which is control means on a recording material P as a recording material (transfer material). The host apparatus B is a computer, an image reader or the like. A control circuit portion A delivers and receives an electrical signal with host apparatus B to exchange the electrical signal between an image formation process means and to carry out an image formation sequence control.

Here, in the image forming apparatus 1, the front side or the front side (before side) is a side which is provided with an openable and closable door 2. The rear side (backside) is a side opposite therefrom. The left and right are the left and right as seen from the front side. The main assembly of an image forming apparatus is a portion of the image forming apparatus other than the process cartridge.

In FIG. 1, designated by reference numeral 4 is an intermediary transfer belt unit. The unit 4 is provided with an internal secondary transfer roller 5 disposed at the right-hand side in the device, a follower roller 6 disposed at the left-hand side in the device, a tension roller 7 disposed adjacent to the follower roller, and an intermediary transfer belt (transfer material) 8 extended around these three rollers. The intermediary transfer belt (belt) 8 is a dielectric member and is a flexible endless belt. The above described three rollers 5, 6, 7 are parallel with each other along a rotational axis direction. The tension roller 7 is urged upwardly to impart the tension to the belt 8. By the rotation of the internal secondary transfer roller 5, the belt 8 is rotationally driven in the counterclockwise direction of an arrow at a predetermined speed. Inside the belt between the follower roller 6 and the internal secondary transfer roller 5, the first-fourth primary transfer rollers (primary transfer means) 9 are provided in parallel relative to each other along the rotational axis direction with a predetermined gap from the left to the right in a belt moving direction. In an outside of a belt at the follower roller 6, a belt cleaning device 10 for cleaning an outer surface of a belt 8 is provided.

Below the belt 8, a plurality of process cartridge (cartridges) is provided in parallel relative to each other. In the present embodiment, first-fourth cartridges 11Y, 11M, 11C, 11K are provided from left-hand side to right-hand side along a movement direction of a belt portion between the follower roller 6 and the internal secondary transfer roller 5. In other words, an intermediary transfer belt unit 4 is provided over the first-fourth cartridges 11Y, 11M, 11C, 11K.

As shown in FIG. 3, each process cartridge 11 is detachably mountable relative to the mounting portion 63 provided in an opening which appears when the openable and closable door 2 is opened. All the process cartridges are electrophotographic processing mechanisms which have the similar structures and each is provided with the electrophotographic photosensitive member (drum) 12 of a drum type as an image bearing member. It further comprises a primary charging device (charging member) 13, a developing device 14, and a drum cleaning device (cleaning member) 15 which is image forming process means which acts on a drum 12. A primary charging device 13 is charging means for charging a surface of the drum 12 uniformly to the predetermined polarity and potential, and it is a charging roller in the present embodiment. The developing device 14 carries a developer which contains a toner on a developer carrying member (developing sleeve), and develops an electrostatic image on the drum 12 into a toner image. A drum cleaning device 15 is a cleaning member for cleaning the surface of the drum 12, and it is a cleaning blade in the present embodiment.

A first cartridge 11Y forms a yellow toner image on the drum 12, and a developing device therein 14 contains the yellow toner as the developer. A second cartridge 11M forms a magenta (M) toner image on the drum 12, and a developing device therein 14 contains the magenta toner as the developer. A third cartridge 11C forms a cyan (C) toner image on the drum 12, and a developing device therein 14 contains the cyan toner as the developer. A fourth cartridge 11K forms a black (K) toner image on the drum 12, and a developing device therein 14 contains the black toner as the developer.

Each cartridge is provided in parallel with the rotational axis direction of the drum 12, and an upper surface of the drum 12 contacts to a lower surface of a lower travelling portion of the belt 8 between the follower roller 6 and the secondary transfer roller 5. The first-fourth primary transfer rollers (transferring devices) 9 oppose, interposing the lower travelling portion of the belt 8, to the upper surface of the drum 12 of the corresponding cartridge. In each cartridge, a contact portion between the drum 12 and the belt 8 is a primary transfer portion T1.

Below the first-fourth cartridges 11Y, 11M, 11C, 11K, the laser scanner units 16 which are the exposure devices for the drums 12 of the cartridges is provided. The unit 16 comprises the laser beam emitting means which carries out a modulation luminescence correspondingly to a time series electrical digital pixel signal of the image information, a polygonal mirrors, an image forming optical systems, and the reflection mirrors.

Below the laser scanner unit 16, a sheet cassette 17 which stacks recording material P (transfer materials) is provided. This sheet cassette 17 is inserted and drawn in a front side of the image forming apparatus (frontloading). Designated by 17*a* (FIG. 2) is a grip portion provided on a front side plate of the sheet cassette 17, for cassette handling.

To the outside of the belt supporting portion at the internal secondary transfer roller 5, an external secondary transfer roller (secondary transfer means) 22 is provided. A contact portion between the belt 8 and the external secondary transfer roller 22 is a secondary transfer portion T2.

The operation for forming a full-color image is as follows. An electric recording image signal with respect to the full-color image is inputted to the control circuit portion A from the host apparatus B. The control circuit portion A carries out the image forming process for the inputted recording image signal, and actuates the first-fourth cartridges 11 Y-K at the predetermined control timing. In this manner, each drum 12 is rotated clockwisely at predetermined same speed of the arrow. The charging roller 13 as the primary charger is rotated by the rotation of the drum 12. The belt 8 is rotated counter-clockwisely at substantially same peripheral speed as a peripheral speed of the drum 12 by the rotation of the internal secondary transfer roller 5 which is the driving roller. The rotating surface of the drum 12 is uniformly charged to the predetermined polarity and potential by the charging roller 13. The surface where the drum 12 has been charged is exposed to the image light by the laser scanner unit 16. The unit 16 outputs a laser beam L modulated correspondingly to the recording image signal inputted from control circuit portion A, and the charged surface of the drum 12 is exposed to the scanning light. In this manner, the electrostatic image corresponding to the scanning and exposure pattern is formed on the drum surface. The formed electrostatic image is developed into the toner image by the developer carrying member (developing roller) 150 of the developing device 14.

Therefore, in the first cartridge 11Y, a yellow toner image corresponding to the yellow component image of the full-color image is formed at the predetermined control timing on the surface of the drum 12. A magenta toner image corresponding to a magenta component image of the full-color image is formed at the predetermined control timing on the surface of the drum 12 in the second cartridge 11M. In the third cartridge 11C, a cyan toner image corresponding to a cyan component image of the full-color image is formed at the predetermined control timing on the surface of the drum 12. In a fourth cartridge K, a black toner image corresponding to a black component image of the full-color image is formed at the predetermined control timing on the surface of the drum 12.

In the primary transfer portion T1 of the first cartridge 11Y, the yellow toner image formed on the drum 12 of the cartridge 11Y is transferred (primary transfer) onto the belt 8 which is rotated. Subsequently, in the primary transfer portion T1 of the second cartridge 11M, the magenta toner image formed on the drum 12 of the cartridge 11M is superimposedly transferred (primary transfer) onto the above described yellow toner image on the belt 8. Moreover, similarly, the magenta toner image and the black toner image are sequentially transferred (primary transfer) onto the belt 8 in the primary transfer portions T1 of the third cartridge 11C and the fourth cartridge 11K, respectively. In other words the Y color, M color, C color and Bk color toner images are sequentially superimposedly transferred on the belt 8 (superimposing transfer) to synthetically form a full-color toner image. A transferring order of the color toner images superimposedly transferred onto the belt 8 is not limited to the above described order.

In each of the primary transfer portions T1, the a primary transfer of the toner image to the belt 8 from the drum 12 is carried out by applying a predetermined primary transfer bias voltage from a voltage source portion to the primary transfer roller 9 to transfer electrostatically a developer image (toner image) on the image bearing member onto the belt 8.

In each cartridge, the remaining toner after the primary transfer is removed by a cleaning blade 15 from the surface of the drum 12 after passing the primary transfer portion to be provided in the repeated image forming operation.

The full-color toner image formed on the belt 8 as described above is fed to the secondary transfer portion T2 by a continuing rotation of the belt 8.

On the other hand, the pick-up roller 18 is driven at the predetermined control timing to feed one recording material P from a cassette 17 in cooperation with a separation pad 19. The fed recording material P is guided upwardly by a longitudinal feeding path 20 to reach registration rollers 21. The recording material P is timed with the toner image on the belt 8 by the registration rollers 21, and thereafter it is fed to the secondary transfer portion T2. In the process in which recording material P is nipped and fed in the secondary transfer portion T2, a predetermined secondary transfer bias voltage is applied from the voltage source portion to the external secondary transfer roller 22 to transfer (secondary transfer) the full-color toner image on the belt 8 all together onto recording material P.

The recording material P having departed the secondary transfer portion T2 is separated from the belt 8, and it is introduced into a fixing unit 24, while being guided by a feeding guide 23. In this embodiment, the fixing unit 24 is a heat-and-pressure fixing device which is provided with a heat roller 24*a* and a pressing roller 24*b* and recording material P is introduced into a fixing nip which is a press-contacting portion between the rollers to be subjected to the heat and the pressure during the nipping and feeding. In this manner, the toner melts and mixes in color and it fixes on the surface of the recording material as a full-color print image.

The recording material P having departed the fixing unit 24 is fed through a first sheet discharging roller pair 25, a feeding path 26, and a second sheet discharging roller pair 27, and is discharged to a sheet discharge tray on an upper surface of the device 29 through a sheet discharge opening 28.

From the surface of the belt after the recording material separation 8, the toner remaining after the secondary transfer is removed by a belt cleaning device 10 during the continuing a rotation process of the belt 8, to be provided for a following image formation step.

In the case of a monochromatic printing mode, the operation control only of the fourth cartridge 11K for forming K (black) color toner image is carried out. In the first-third cartridges 11Y, 11M, 11C, an image forming operation is not carried out although the drum 12 is rotated.

In the image forming apparatus of the present embodiment, the first-fourth cartridges 11Y, 11M, 11C, 11K are disposed below the intermediary transfer belt unit 4, and therefore, the a distance between the primary transfer portion T1 and the secondary transfer portion T2 for the black toner image is shortened as compared with the case of the upper part disposition. In this manner, the time from the pick-up of recording material P to the discharging is shortened.

In the cartridge of the present embodiment, the charging roller 13 is movable to and away relative to a photosensitive drum 12. In an initial state after being shipped in an individual packaging, or in the case where it is packed in the image forming apparatus main assembly, a spacer member 100 which spaces the charging roller 13 from the photosensitive drum 12 as shown in FIG. 4, is mounted.

Figure 4:
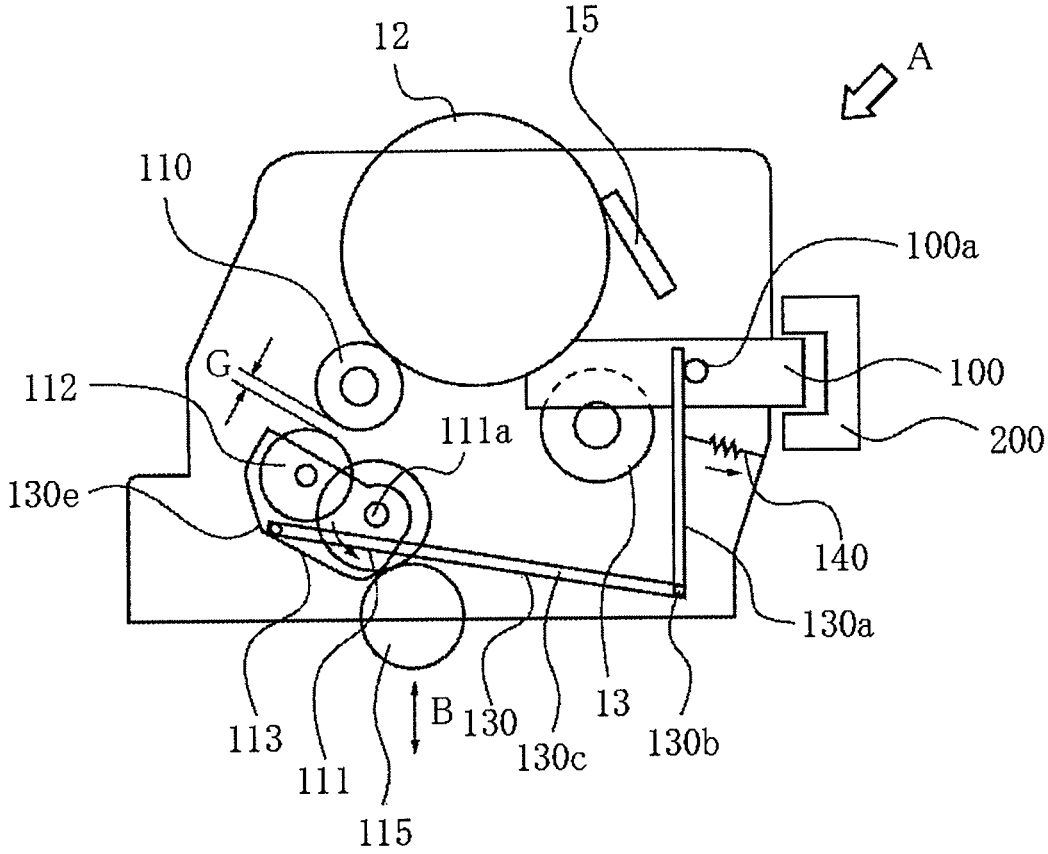
FIG. 4 is a view illustrating a mounted state of a spacer member in the embodiment 1.
Figure 5:
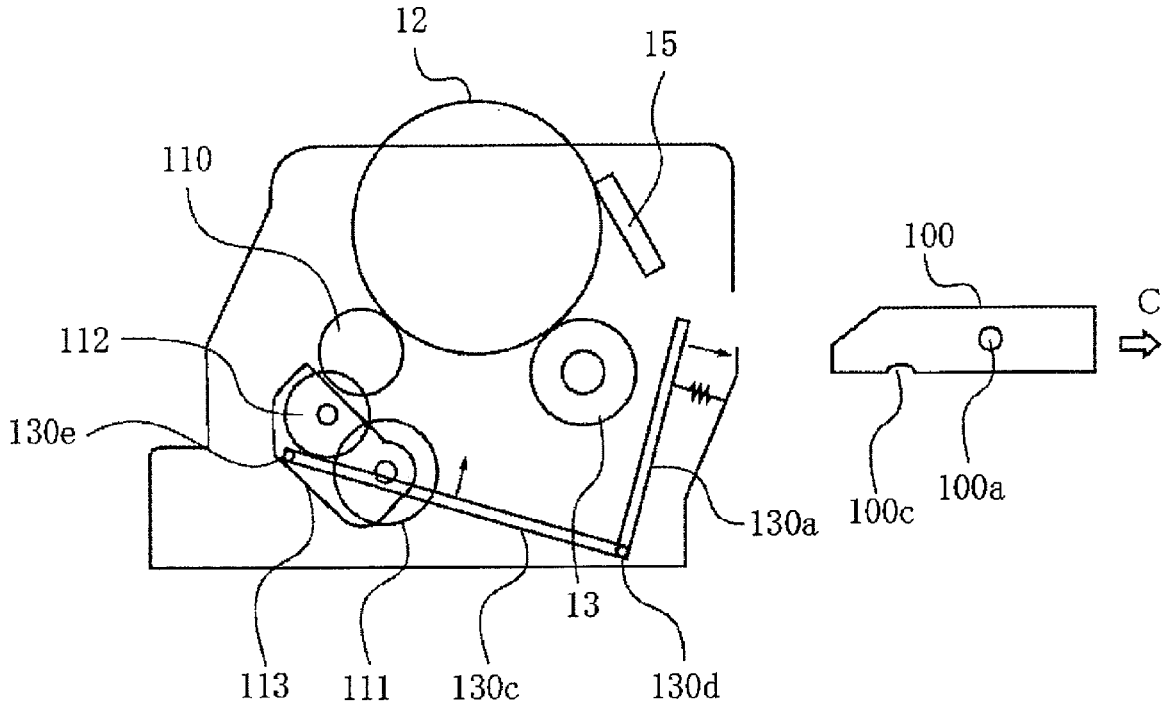
FIG. 5 is a view illustrating a disengagement state of the spacer member in the embodiment 1.
Figure 6:
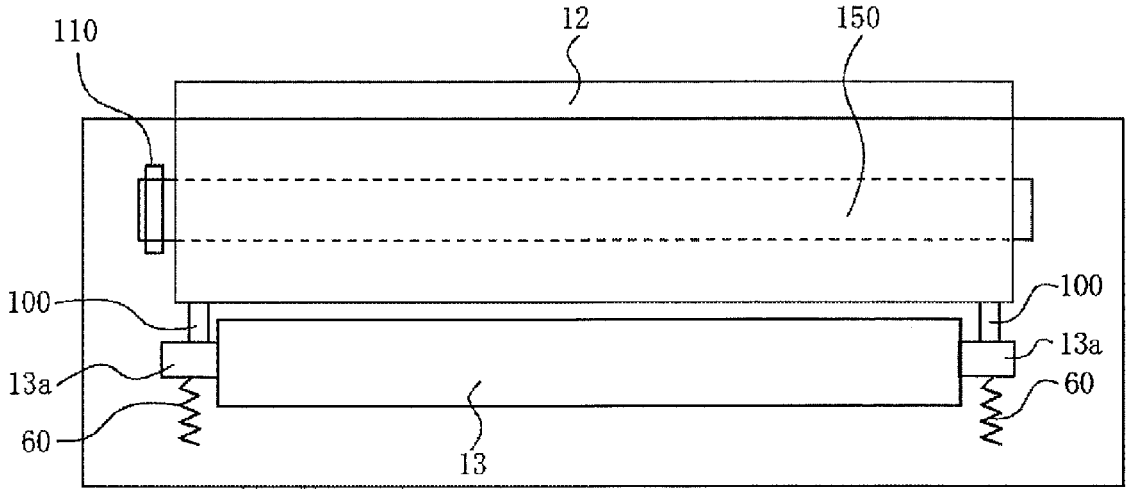
FIG. 6 is a view illustrating the structure in a longitudinal direction in the embodiment 1.
Figure 7:
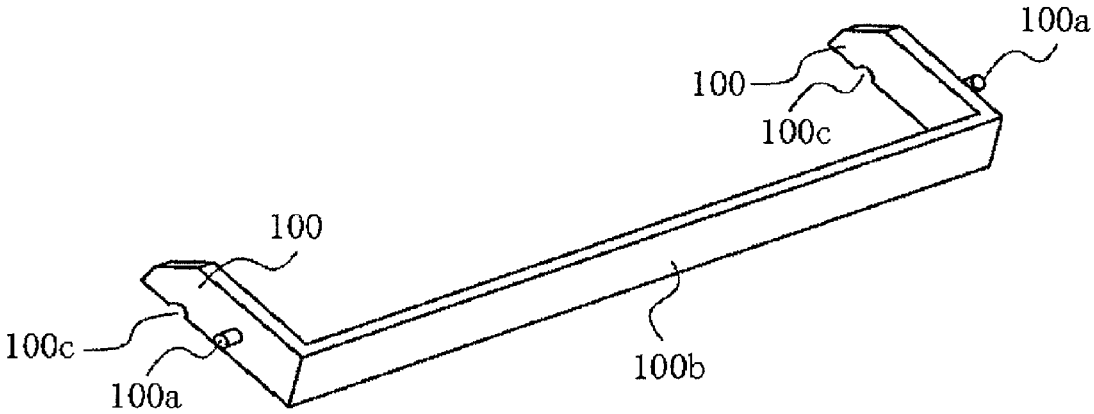
FIG. 7 is a perspective view of the spacer member.
Figure 8:
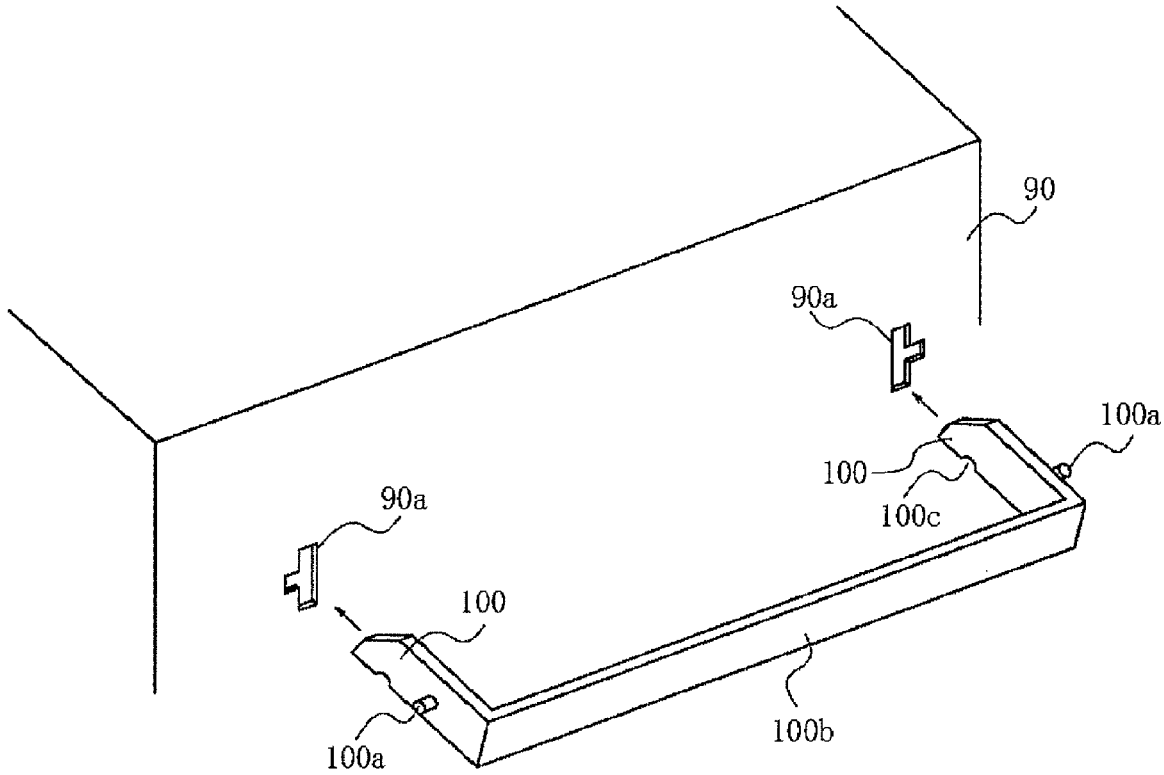
FIG. 8 is a perspective view illustrating the state that the spacer member is mounted.
Figure 9:
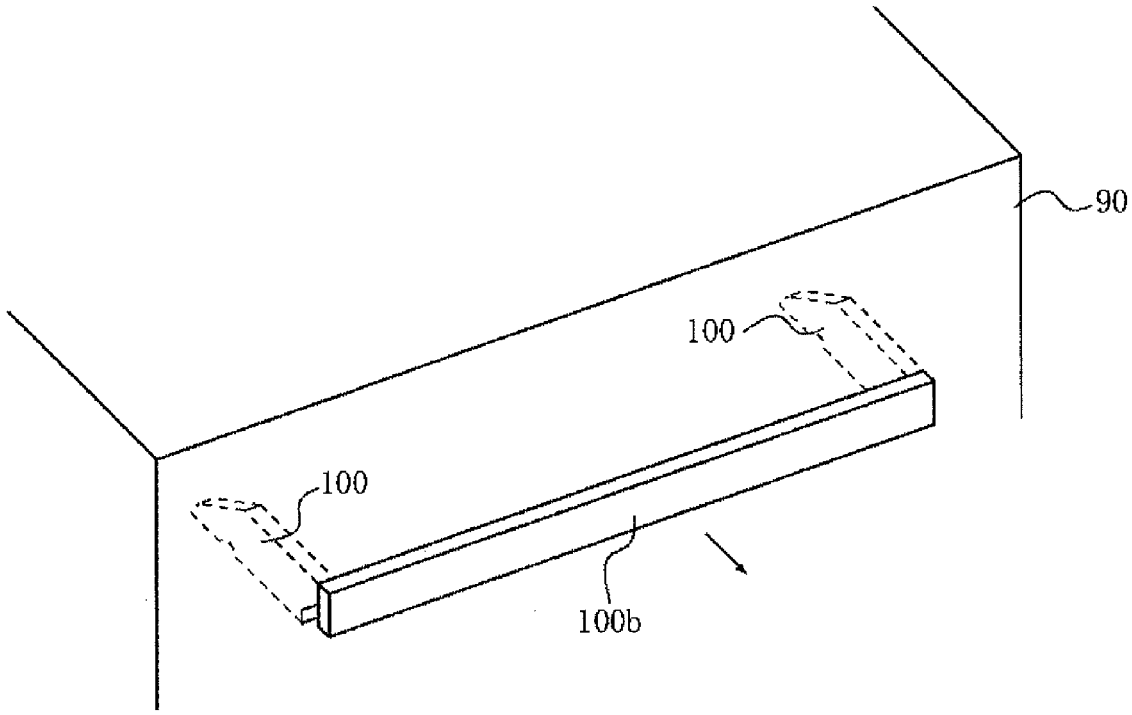
FIG. 9 is a perspective view illustrating the state that the spacer member is mounted.

Referring to FIG. 4-FIG. 9, the present embodiment will be described. FIG. 4 is a view illustrating a mounted state of a spacer member, and FIG. 5 is a view illustrating a disengagement state of the spacer member. FIG. 6 illustrates a disposition with respect to the longitudinal direction of some constituent parts of the process cartridge as seen in the direction of arrow A in FIG. 4. FIG. 7 is a perspective view of the spacer member. FIG. 8 is a perspective view illustrating the disengagement state of the spacer member, and FIG. 9 is a perspective view illustrating the mounted state of the spacer member.

The charging roller 13 is urged and contacted to the photosensitive drum 12 by an urging member (spring) 60 for urging opposite ends of a rotation axis 13*a*. When the spacer member 100 is mounted, as shown in FIG. 6, a spacing portion 100 of the spacer member spaces the charging roller 13 from the photosensitive drum 12, while contacting to the rotation axis 13*a*, and it holds the charging roller in a spaced position. The distance between the charging roller and a photosensitive drum at this time is G.

As shown in FIG. 7, the spacer member 100 is provided with a plurality of such spacing portions 100 arranged in the rotational axis direction of the charging member. In the present embodiment, the number of spacing portions is two. The spacing portions 100 are connected with each other by a connecting portion 100*b*, and are operated integrally. Moreover, the spacing portion 100 is provided with a recess 100*c*, and when the spacer member is mounted and the charging roller is spaced, the recess 100*c* is engaged with the rotation axis 13*a* which is a part of the charging members. In this manner, the retention of the spacer member 100 can be accomplished by a simple structure.

In mounting the spacer member, the spacing portion 100 enters a hole 90*a* (mounting portion) provided in a frame 90 of the process cartridge as shown in FIG. 8. FIG. 9 illustrates the state that the spacer member is set. In the disengaged state that the spacer member 100 is removed from the process cartridge in the direction of in arrow C in a FIG. 5, the charging roller is contacted to the photosensitive drum, as shown in FIG. 5.

A driving gear (first gear) 110 is provided at an end of the developing roller 150 which is the developer carrying member, to transmit a driving force to the developing roller. An input gear 111 receives the drive from a gear 115 which is a part of driving means which is provided in the main assembly side, to transmit the driving force to a swinging gear (second gear) 112. A swinging gear 112 is held by a gear holder 113, and is swingable around a rotation axis of the input gear 111. The driving gear 110 and the swinging gear 112 is engageable with each other by this swinging operation, and it is disengageable from each other. In the present embodiment, the swinging gear 110, the input gear 111, and the gear holder 113 transmit the driving force received from the image forming apparatus main assembly to the developer carrying member (developing roller) (drive transmission mechanism).

A link portion 130 which is a drive transmission controlling mechanism is connected to the gear holder 113. The link portion 130 is swingable around a rotational fulcrum 130*d*, and it urges in the direction indicated by an arrow in FIG. 4 by a spring 140 which is the urging member. In the mounted state of the spacer member 100, as shown in FIG. 4, the end of the link portion 130 is contacted to a projection 100*a* provided on one of the spacing portions of the spacer member 100, to hold the swinging gear 112 at the position spaced by gap G from the driving gear 110. At this time, the driving connection is released between the swinging gear 112 and the driving gear 110*s*, and therefore, when the input gear 111 is driven, the driving gear 110 is not rotated although the swinging gear 112 is rotated.

Therefore, in the present embodiment, even if the process cartridge to which the spacer member is mounted is mounted to the image forming apparatus main assembly and the drive is received from the main assembly side, an excessive developer supply to the photosensitive drum does not occur, since the driving connection to the developing roller is not established.

FIG. 5 shows the state that an operator (user) takes out the process cartridge from the inside of the main assembly, or from an individual packing case, and dismounts the spacer member 100. When the spacer member 100 is dismounted, the charging roller 13 is released from the spaced state to contact to the photosensitive drum 12, and therefore, the state with which it can be supplied the electric power is established and an electrical charging operation is enabled. The projection 100*a* is dismounted with the spacer member 100, by which the link portion 130 rotates in the direction indicated by the arrow in FIG. 5, and the drive transmission mechanism moves the swinging gear 112 to the position engageable with the driving gear 110. In this manner, when the process cartridge is mounted in the main assembly in the disengagement state of the spacer member, the swinging gear 112 and the driving gear 110 are connected operatively with each other, and therefore, when the input gear 111 is driven, the driving gear 110 rotates and the drive of the developing roller 150 is enabled. In this manner, the normal image forming operation is enabled.

In this embodiment, even if the image forming apparatus operates without the removal of the spacer member 100, a defect by the developing device does not occur. However, if the user can recognize that the spacer member is not disengaged, the usability is improved.

Then, in this embodiment, a sensing device detects whether the spacer member is mounted or not, and, when the mounting of the spacer member is detected, the display for prompting the disengagement of the spacer member may be made on the display device.

Figure 10:
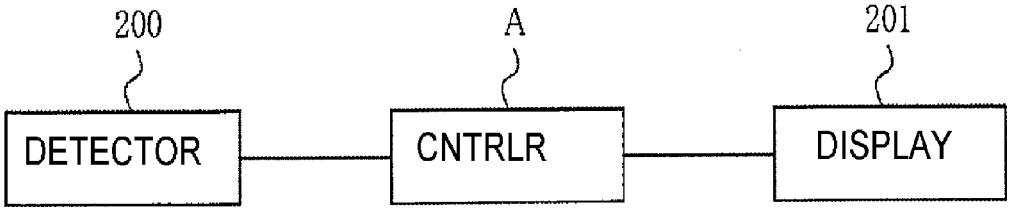
FIG. 10 is a control block Figure in the embodiment 1.
Figure 11:
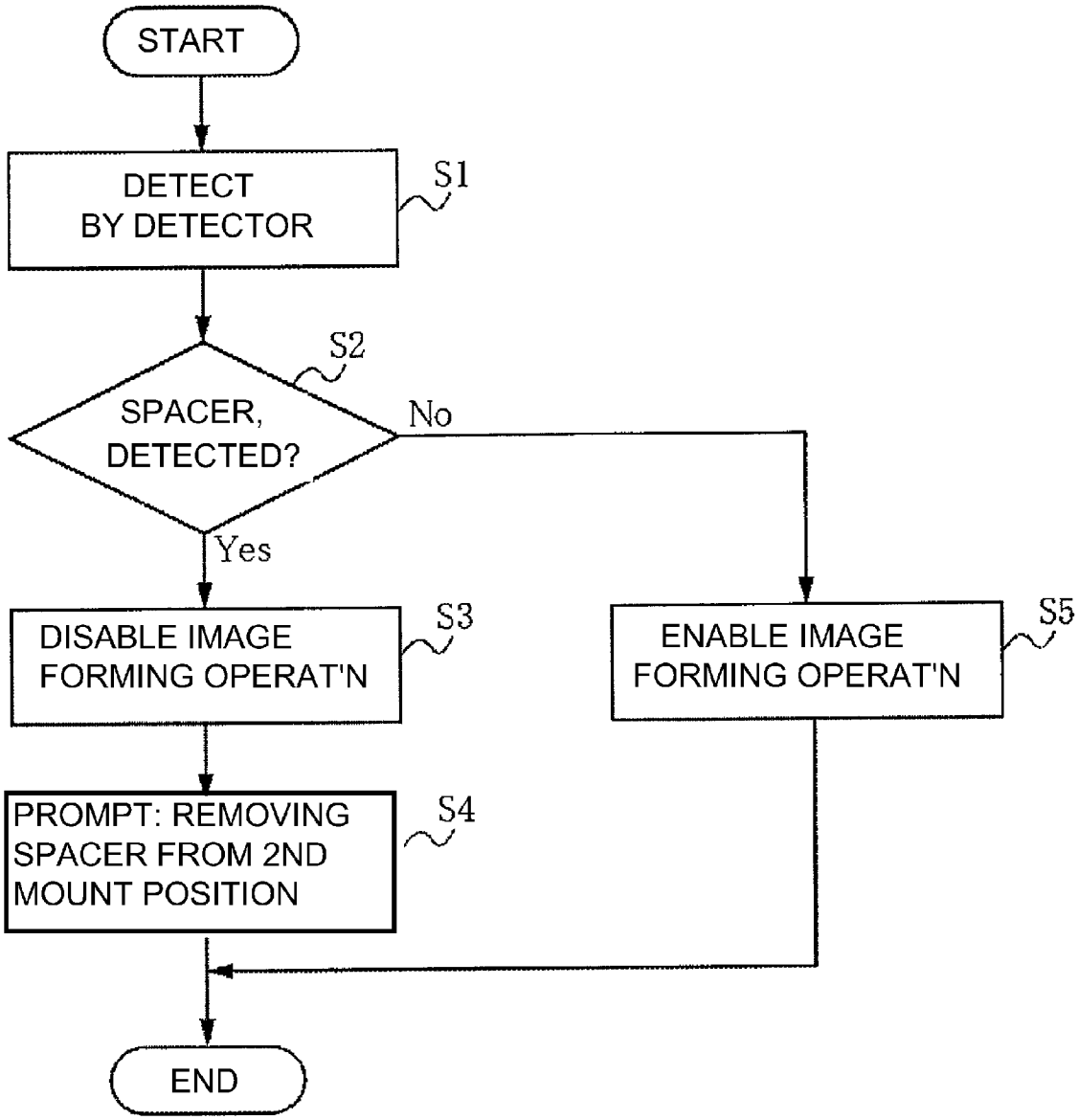
FIG. 11 is a control flow-chart in the embodiment 1.

FIG. 10 and FIG. 11 illustrate the structure therefor. FIG. 10 is a control block Figure and FIG. 11 is a flow-chart.

In the present embodiment, a detecting sensor 200 which is the sensing device for detecting whether the spacer member 100 is mounted to the mounted process cartridge or not is provided in the main assembly. The detecting sensor 200 is connected with control means A, and is provided with a display device 201 for prompting the disengagement of the spacer member, when the mounting of the spacer member is detected. This display device may be provided in the image forming apparatus main assembly, or an external host device B (PC, for example) connected with the image forming apparatus main assembly. A result of detection of the detecting sensor 200 is transmitted to control means A, and is displayed on the display device by control means A.

A control flow will be described referring to FIG. 11.

First, the detecting operation is carried out by the detecting sensor 200 (S1). The detecting sensor 200 discriminates whether the spacer member 100 detected or not (S2). If the spacer member is detected, the execution of the image forming operation in the image forming apparatus is prohibited (S3) and the display for prompting the disengagement of the spacer member is made on the display device 201 (S4). On the other hand, if absence of the spacer member is detected, the image forming operation is enabled (S5).

In this embodiment, in order to drive the developing device 14, the switching by the swinging gear is used, but the present invention is not limited to this example, and if a drive transmission to the developing device 14 is changed on the basis of the presence or absence of the spacer member 100, it is usable. For example, a coupling may be used.

Second Embodiment

In the first embodiment, the spacer member for spacing the charging roller is used, but, the present invention is usable for the device which is provided with the spacer member which spaces the cleaning member for cleaning of the image bearing member.

Figure 12:
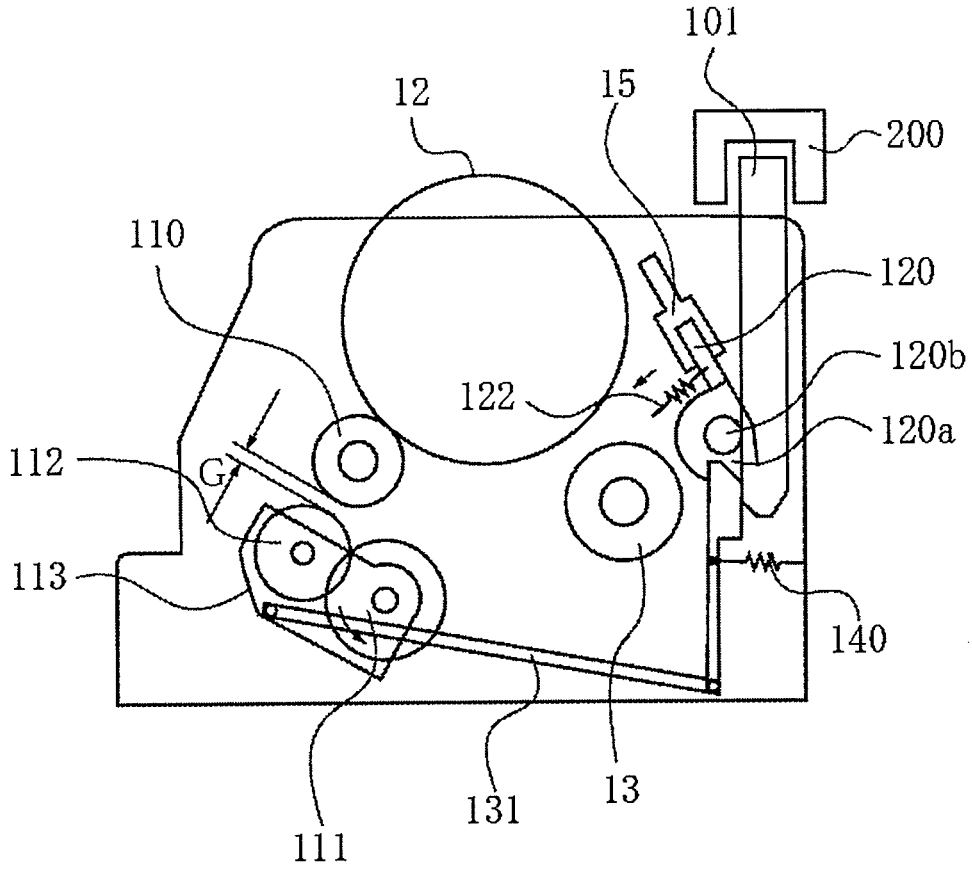
FIG. 12 is a view illustrating the mounted state of the spacer member in the embodiment 2.
Figure 13:
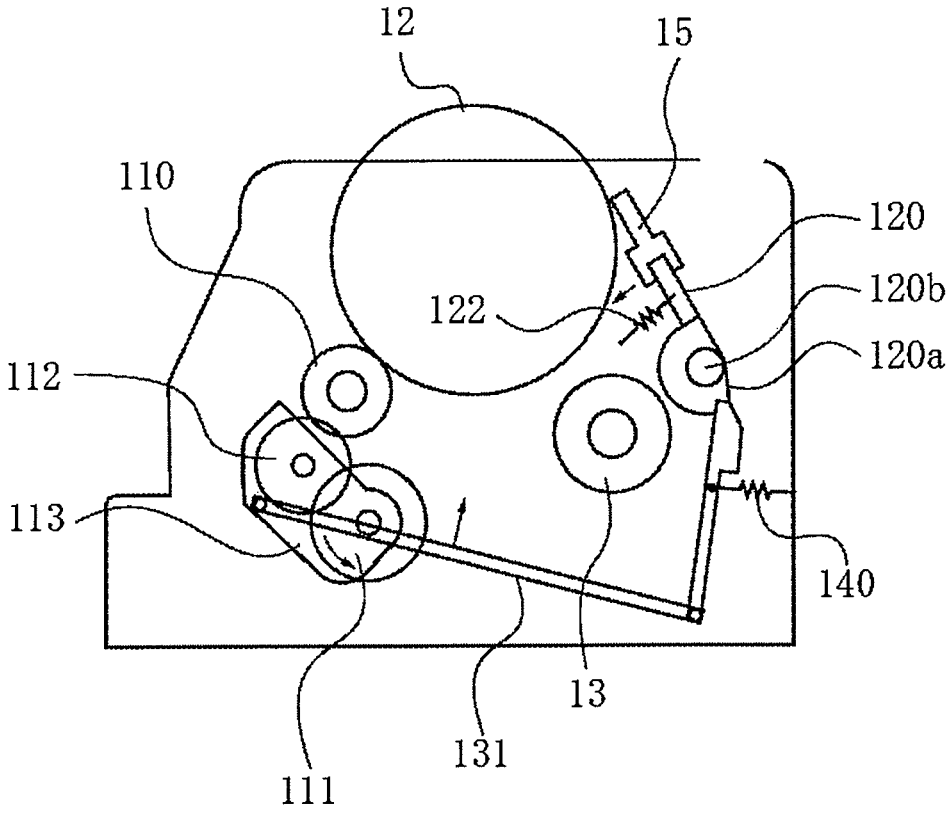
FIG. 13 is a view illustrating the disengagement state of the spacer member in the embodiment 1.

FIG. 12 and FIG. 13 illustrate the structure of the embodiment 2, FIG. 12 illustrates the mounted state of the spacer member, and FIG. 13 illustrates the disengagement state of the spacer member The like reference numerals as in the foregoing embodiments are assigned to the elements having the corresponding functions Also about a rubber used for the cleaning blade 15 which is the cleaning member, there is a liability of a permanent deformation which results from the creep phenomenon, and therefore, it is preferable that the cleaning blade 15 is spaced from the image bearing member, similarly to the embodiment 1. Then, in this embodiment, the structure for spacing the cleaning blade 15 by the spacer member is provided.

A metal holding portion 120 holds the cleaning blade 15, and is rotatable about a rotation axis 120*b*. The holding portion 120 is urged in the direction indicated by the arrow in FIG. 12 by a spring 122 which is the urging member. As shown in FIG. 12, in the mounted state of a spacer member 101, a contact surface 120*a* of the holding portion 120 contacts to a side of the spacer member 101, so that a rotation of the holding portion 120 by the urging of the spring 122 does not occur. In this manner, a blade 15 is kept in the position spaced from the photosensitive drum 12. The spacer member 101 has the structure similar to that of the embodiment 1 and is provided with the spacing portions at the opposite longitudinal end portion. By the spacing portions contacting to the holding portion 120 of a blade, the separating operation is carried out.

In the mounted state of FIG. 12, a part of a link portion 131 which is the drive transmission controlling mechanism contacts to the side of the spacing portion of one spacer member 101 to limit the motion thereof. The link portion 131 is urged by the spring 140 which is the urging member. The link portion 131 has a structure similar to the spacer member 130 of the embodiment 1 and operates it similarly except for the configuration of the portion contacted to the spacer member 101.

The drive transmission mechanisms (112, 111, 113) for transmitting the driving force from the driving portion 115 of the main assembly described in the embodiment 1 to the developing sleeve are provided, the drive transmission mechanism is connected with the link portion 131, and the drive transmission mechanism moves in interrelation with the motion of the link portion 131.

In the state of FIG. 12, the operative connection to the developing sleeve in the drive transmission mechanism is not established, and therefore, even if the drive transmission mechanism receives the drive from the main assembly, the developing sleeve does not rotate.

Therefore, in the state (FIG. 12) in which the spacer member 101 is mounted, the establishment of the spacing state of the blade 15 and the releasing of the driving connection to the developing sleeve are substantially carried out simultaneously.

On the other hand, as shown in FIG. 13, when the spacer member 101 is disengaged, the holding portion 120 contacted to the spacer member 101 is moved in the direction indicated by the arrow in the Figure by the force of the spring 122, so that the blade 15 contacts to the photosensitive drum 12 with a predetermined pressure. With the disengagement of the spacer member 101, the link portion 131 restricted in the movement is also moved in the direction indicated by the arrow in the Figure by the force of the spring 140. With the movement of the link portion 131, the drive transmission mechanism also moves and the gear 112 of the drive transmission mechanism and the gear 110 for driving the developing sleeve engage with each other to establish the driving connection.

Therefore, in the state (FIG. 13) in which the spacer member 101 is disengaged, the spacing contact of the blade 15 and the operative connection to the developing sleeve are substantially carried out simultaneously. In this manner, the image forming operation is enabled.

Also in this embodiment, the display device may be provided similarly to the embodiment 1, wherein the detecting sensor 200 for the spacer member is provided to detect whether the spacer member is mounted or not, and when the mounting of the spacer member is detected, the display for prompting the disengagement of the spacer member may be made on the display device.

Third Embodiment

In the embodiment described above, by removing the spacer member, the driving connection is established automatically to enable the drive transmission to the developing sleeve from the main assembly. In the present embodiment, a spacer member is mounted to a first mounting portion to space the charging roller, and the spacer member is mounted to a second mounting portion, so that the driving connection is established to enable the transmission, to the developing sleeve, of the drive from the main assembly.

Figure 14:
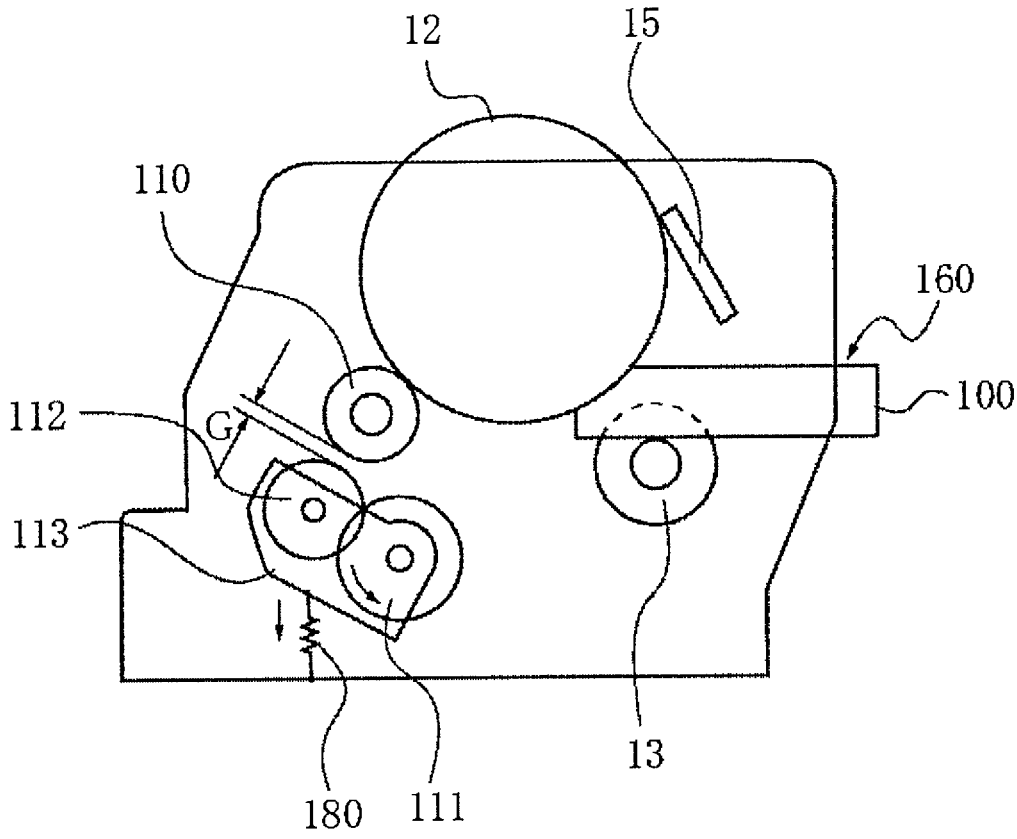
FIG. 14 is a view illustrating the mounted state of the spacer member to a first mounting portion in the embodiment 3.
Figure 15:
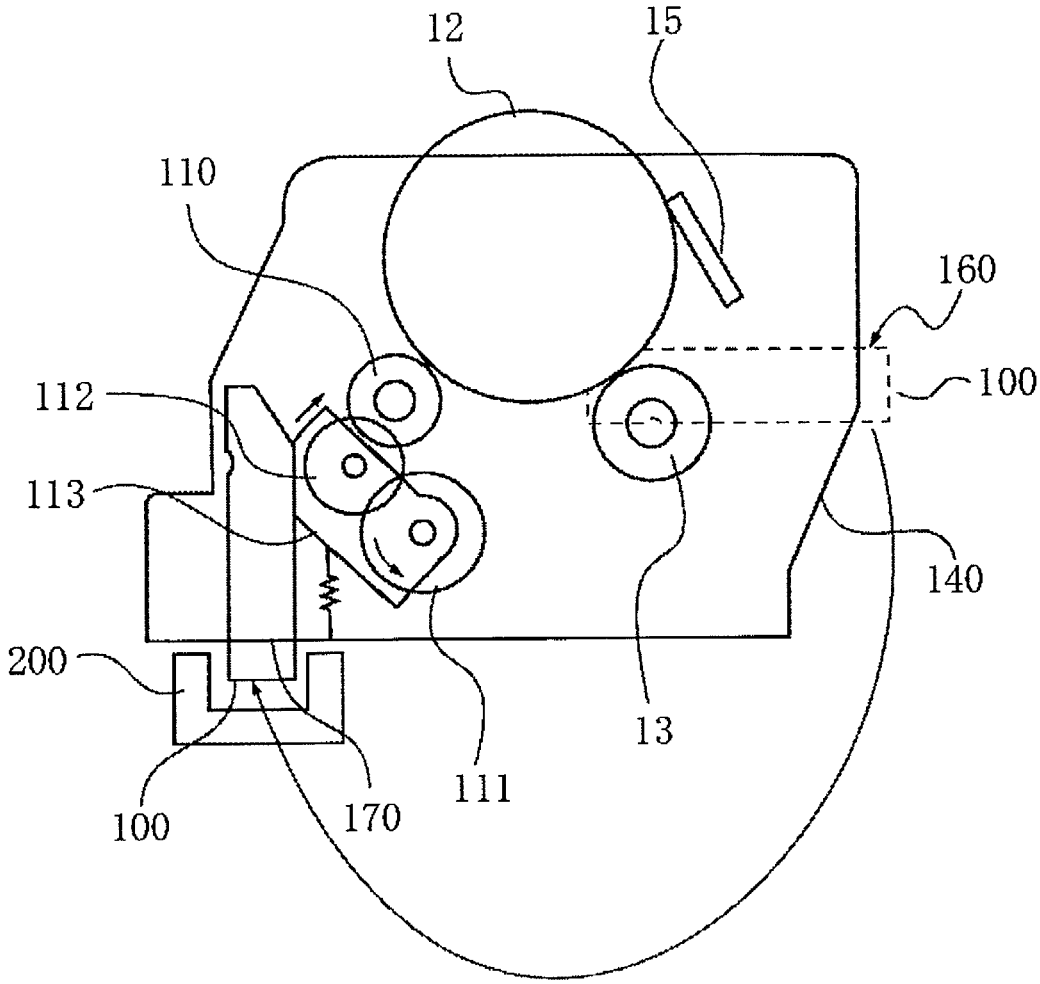
FIG. 15 is a view illustrating the mounted state of the spacer member to a second mounting portion in the embodiment 3.

FIG. 14 illustrates the state that the spacer member is mounted to a first mounting portion 160, and FIG. 15 illustrates the state that the spacer member disengaged from the first mounting portion 160 is mounted to a second mounting portion 170.

In FIG. 14, the spacer member 100 of the structure is mounted to the first mounting portion 160 which is provided with a hole described also in the embodiment 1. In this state, the charging roller 13 is held in the position spaced from the photosensitive drum 12. In the embodiment 1, the drive transmission mechanisms 112, (111, 113) for transmitting the driving force from the driving portion of the main assembly to the gear 110 provided on the developing sleeve 150 is provided at the position at which the operative connection between the gear 110 and the gear 112 is released. More particularly, the urging force of the spring 180 which is the urging member is imparted to the drive transmission mechanism in the direction indicated by the arrow in the Figure, so that it stays at the drive releasing position. Therefore, in the state shown in FIG. 14, the establishment of the spacing state of the charging roller 13 and the releasing of the operative connection to the developing sleeve are carried out substantially simultaneously.

On the other hand, as shown in FIG. 15, when the spacer member 100 is disengaged from the first mounting portion 160, the charging roller 13 is contacted to the photosensitive drum. The disengaged spacer member 100 is mountable to the second mounting portion 170 which is provided with the hole similar to the first mounting portion. When the spacer member 100 is mounted to the second mounting portion 170, a part of spacing portion of a spacer member 110 contacts to the gear holder 113 to rotate the drive transmission mechanism upwardly. In this manner, the gear 112 engages with the gear 110, so that the driving connection is established, and the driving force can be transmitted from the main assembly side to the developing roller 150, and therefore, the developing roller is rotatable.

With such a structure, the process cartridge which is provided with the spacer member is mounted to the image forming apparatus main assembly, and when it receives the drive from the main assembly side, the excessive developer supply to the photosensitive drum does not occur, since the driving connection to the developing roller is not established. Also in this embodiment, even in the case where the image forming apparatus operated without removal of the spacer member 100 from the first mounting portion, the defect of the developing device does not occur. However, when the spacer member is not correctly mounted to the second mounting portion, the developing roller does not move, and it results in incapability of the image forming operation. The usability will be improved if the user can recognize the absence of the spacer member in the second mounting portion.

In this embodiment, it may be that a sensing device detects whether or not the spacer member is mounted to the second mounting portion, and when the mounting of the spacer member is not detected, the display for prompting the mounting of the spacer member to the second mounting portion is made.

Figure 16:
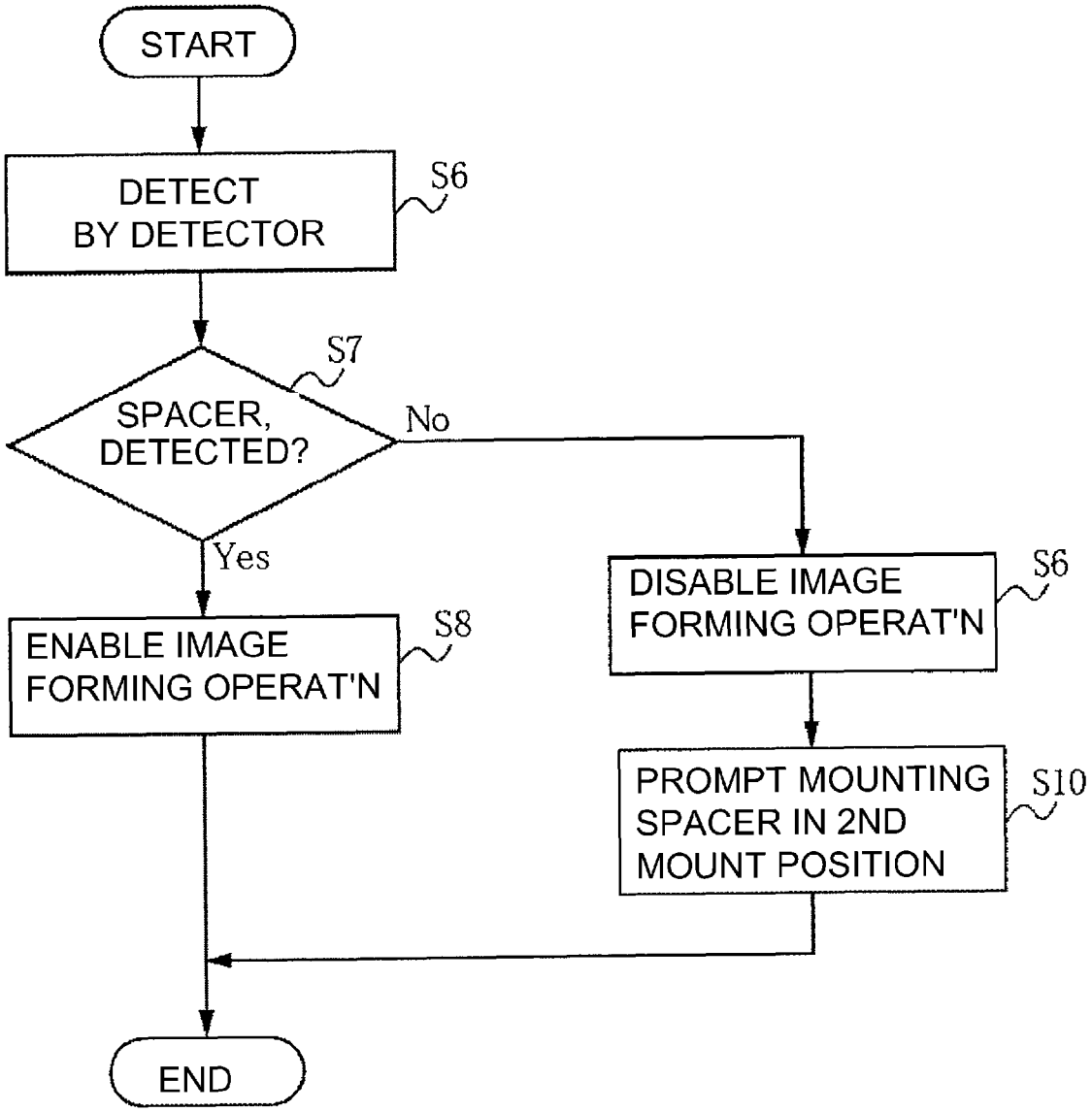
FIG. 16 is a control flow-chart in the embodiment 1.

FIG. 16 is a flow-chart of the operation in the present embodiment.

First, the detecting sensor 200 carries out the detecting operation (S6). The discrimination is made as to whether or not the detecting sensor 200 detects the spacer member 100 in the second mounting portion (S7). If absence of the spacer member is detected, the image forming operation in the image forming apparatus is not enabled (S9), and the display for prompting the mounting of the spacer member is made on the display device 201 (S10). On the other hand, if presence of the spacer member is detected, the image forming operation is enabled (S8).

The present embodiment 3 relates to the spacing structure for the charging roller which is the charging member, but it may be used for the spacing structure for the cleaning member, similarly to the embodiment 2. When the spacer member is removed, the cleaning member is contacted to the image bearing member, and, by the spacer member being mounted to the second mounting portion, the driving connection to the developer carrying member is enabled.

In the embodiments described above the switching structure using the swinging gear is used for the drive of the developing device 14, but the present invention is not limited to this example if the drive transmission to the developing device 14 can be changed in accordance with the presence or absence of the spacer member 100. For example, the coupling may be used.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 302431/2008 filed Nov. 27, 2008 which is hereby incorporated by reference.

What is claimed is:

1. A process cartridge detachably mountable to a main assembly of an image forming apparatus, said process cartridge comprising:

an image bearing member on which an electrostatic image is to be formed;

a developing device, including a developer carrying member for carrying a developer, for developing the electrostatic image;

a contact member contactable to and separable from a surface of said image bearing member;

a spacer member, detachably mountable to said process cartridge, for holding said contact member at a position away from said image bearing member when said spacer member is mounted to a predetermined mounting position of said process cartridge, and for permitting said contact member to contact said image bearing member when said spacer member is dismounted; and a drive transmission member movable between a first position in which a driving force for driving said developer carrying member is not transmitted to said developer carrying member and a second position in which the driving force for driving said developer carrying member is transmitted to said developer carrying member, wherein said process cartridge is mountable to said image forming apparatus in a state that said spacer member is mounted to said process cartridge, and wherein said drive transmission member is in the first position at least when said spacer member is in the predetermined mounting position.

2. A process cartridge according to claim 1, further comprising a gear for transmitting a drive to said developer carrying member, wherein said drive transmission member is engaged with said gear in the second position and disengaged from said gear in the first position, and wherein, when said spacer is mounted to the predetermined mounting position, said drive transmission member is prevented by said spacer member from moving to the second position.

3. A process cartridge according to claim 1, wherein said spacer member is provided with a recess engageable with said contact member when said spacer member is mounted to the predetermined mounting position.

4. A process cartridge according to claim 1, wherein said spacer member is provided with a plurality of spacing portions for spacing said contact member from said photosensitive member at different positions with respect to a direction of a rotational axis of said contact member.

5. A process cartridge according to claim 1, further comprising:

a transferring device for transferring a developed image formed on said image bearing member by said developing device onto a transfer material;

a mounting portion for mounting said process cartridge having said spacer member mounted thereto;

a detecting device for detecting whether or not said spacer member is mounted to the predetermined mounting position; and a display device for displaying a prompt for prompting an operator to dismount said spacer member from the predetermined mounting position when said detecting device detects said spacer member mounted to the predetermined mounting position.

6. A process cartridge according to claim 1, wherein said contact member is a charging member for charging said image bearing member.

7. A process cartridge according to claim 1, wherein said contact member is a cleaning member for cleaning a surface of said image bearing member.

8. A process cartridge according to claim 1, wherein said spacer member is mountable to a second mounting position that is different from the predetermined mounting position and in which said drive transmission member is moved to the second position.

9. An image forming apparatus comprising:

a process cartridge according to claim 8;

a mounting portion for mounting said process cartridge having said spacer member mounted thereto;

a detecting device for detecting whether or not said spacer member is mounted to the second mounting position; and a display device for displaying a prompt for prompting the operator to mount said spacer member to the second mounting position when said detecting device detects that said spacer member is not mounted to the second mounting position.

* * * * *